US010202953B2

(12) United States Patent
Filippi et al.

(10) Patent No.: US 10,202,953 B2
(45) Date of Patent: Feb. 12, 2019

(54) INJECTOR FOR A COMBUSTION ENGINE

(71) Applicant: Continental Automotive GmbH, Hannover (DE)

(72) Inventors: Stefano Filippi, Castel' Anselmo Collesalvetti (IT); Valerio Polidori, Livorno (IT); Francesco Lenzi, Livorno (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 23 days.

(21) Appl. No.: 15/028,119

(22) PCT Filed: Oct. 9, 2014

(86) PCT No.: PCT/EP2014/071638
§ 371 (c)(1),
(2) Date: Apr. 8, 2016

(87) PCT Pub. No.: WO2015/052281
PCT Pub. Date: Apr. 16, 2015

(65) Prior Publication Data

US 2016/0237966 A1 Aug. 18, 2016

(30) Foreign Application Priority Data

Oct. 10, 2013 (EP) ..... 13187995

(51) Int. Cl.
*F02M 51/06* (2006.01)
*F02M 61/20* (2006.01)

(52) U.S. Cl.
CPC .... *F02M 51/0685* (2013.01); *F02M 51/0653* (2013.01); *F02M 51/0682* (2013.01);
(Continued)

(58) Field of Classification Search
CPC ..... F02M 2200/306; F02M 2200/9015; F02M 51/0653; F02M 51/0671; F02M 51/0682; F02M 51/0685; F02M 61/205
(Continued)

(56) References Cited

U.S. PATENT DOCUMENTS 1,758,105 A * 5/1930 French ..... F02M 51/0653 251/65
4,978,074 A * 12/1990 Weinand ..... F02M 51/066 239/585.3

(Continued)

FOREIGN PATENT DOCUMENTS

CN 102405344 A 4/2012 ..... F02M 51/06
CN 103119283 A 5/2013 ..... F02M 51/06

(Continued)

OTHER PUBLICATIONS

European Search Report, Application No. 13187995, 6 pages, dated Jan. 7, 2014.

(Continued)

*Primary Examiner* — John Zaleskas
(74) *Attorney, Agent, or Firm* — Slayden Grubert Beard PLLC

(57) ABSTRACT

An injector for a combustion engine may include a valve housing, a valve needle, an electromagnetic actuator, and a damping element. The valve needle may be axially movable within a valve cavity of the housing. The electromagnetic actuator may comprise a pole piece coupled with the valve housing and an armature axially movable within the valve cavity. The pole piece may have a central recess extending axially there through. The central recess may include a step defining a first portion and a second portion, the first having a larger cross-sectional area than the second, and a stop surface defined by a radially extending surface of the step. The valve needle may include an armature retainer in the
(Continued)

first portion of the central recess. The armature may be axially displaceable with respect to the valve needle and interact with the valve needle by means of the retainer for actuating the valve needle. The damping element may be arranged between the stop surface and the armature retainer to interact with the valve needle and the pole piece during movement.

17 Claims, 3 Drawing Sheets

(52) U.S. Cl.
CPC ..... *F02M 61/205* (2013.01); *F02M 2200/306* (2013.01); *F02M 2200/9015* (2013.01)

(58) Field of Classification Search
USPC ..... 123/472; 239/584, 585.1, 585.3, 585.4, 239/585.5
See application file for complete search history.

(56) References Cited

U.S. PATENT DOCUMENTS

| | | | | |
|---|---|---|---|---|
| 6,510,841 | B1 * | 1/2003 | Stier | F02M 51/0625 123/472 |
| 6,612,539 | B1 | 9/2003 | Ruehle et al. | 251/64 |
| 6,808,133 | B1 * | 10/2004 | Stier | F02M 51/0614 239/585.1 |
| 6,994,281 | B2 * | 2/2006 | Reiter | F02M 51/0685 239/533.2 |
| 8,919,372 | B2 | 12/2014 | Fischetti et al. | 137/514.7 |
| 9,528,480 | B2 | 12/2016 | Omeri | |
| 2002/0063173 | A1 * | 5/2002 | Spakowski | F02M 51/0625 239/585.1 |
| 2003/0155440 | A1 * | 8/2003 | Reiter | F02M 51/0685 239/533.2 |
| 2003/0189112 | A1 * | 10/2003 | Fukutomi | F02M 51/0671 239/585.1 |
| 2005/0017097 | A1 * | 1/2005 | Hans | F02M 51/0685 239/585.1 |
| 2007/0029413 | A1 * | 2/2007 | Nakajima | F02M 21/0254 239/585.5 |
| 2009/0007886 | A1 * | 1/2009 | Akabane | F02M 51/005 123/476 |
| 2012/0318885 | A1 * | 12/2012 | Grandi | F02M 51/066 239/5 |
| 2013/0327970 | A1 | 12/2013 | Pilgram | 251/129.15 |
| 2014/0123933 | A1 * | 5/2014 | Okamoto | F02M 51/0671 123/294 |
| 2014/0123946 | A1 * | 5/2014 | Grandi | F02M 51/066 123/445 |
| 2015/0204289 | A1 * | 7/2015 | Agresta | F02M 51/066 123/478 |
| 2016/0053731 | A1 * | 2/2016 | Mechi | F02M 51/0671 239/585.5 |

FOREIGN PATENT DOCUMENTS

| | | | | |
|---|---|---|---|---|
| DE | 19921489 | A1 | 11/2000 | F02M 51/06 |
| DE | 10256661 | A1 * | 6/2004 | F02M 51/0685 |
| DE | 102006049253 | A1 * | 4/2008 | F02M 51/0671 |
| DE | 102010064105 | A1 | 1/2012 | F02M 25/08 |
| DE | 102004037250 | * | 1/2014 | F02M 51/0671 |
| EP | 1262655 | A2 | 12/2002 | F02M 51/06 |
| EP | 1795739 | A1 | 6/2007 | F02M 51/02 |
| EP | 2112366 | A1 | 10/2009 | F02M 51/06 |
| EP | 2336544 | A1 * | 6/2011 | F02M 51/061 |
| EP | 2634413 | A1 * | 9/2013 | F02M 51/066 |
| JP | 2003021014 | A * | 1/2003 | F02M 51/0671 |
| JP | 2011137442 | A * | 7/2011 | F02M 51/0685 |
| WO | 2015/052281 | A1 | 4/2015 | F02M 51/06 |

OTHER PUBLICATIONS

International Search Report and Written Opinion, Application No. PCT/EP2014/071638, 10 pages, dated Jan. 22, 2015.
Chinese Office Action, Application No. 201480055686.2, 12 pages, dated Jul. 21, 2017.
Korean Office Action, Application No. 2017063653490, 14 pages, dated Sep. 11, 2017.

* cited by examiner

INJECTOR FOR A COMBUSTION ENGINE

CROSS-REFERENCE TO RELATED APPLICATIONS

This application is a U.S. National Stage Application of International Application No. PCT/EP2014/071638 filed Oct. 9, 2014, which designates the United States of America, and claims priority to EP Application No. 13187995.9 filed Oct. 10, 2013, the contents of which are hereby incorporated by reference in their entirety.

TECHNICAL FIELD

The present disclosure relates in general to injectors and more specifically to an injector for a combustion engine.

BACKGROUND

Injectors are in widespread use, in particular for internal combustion engines, where they may be arranged in order to dose the fluid into an intake manifold of the internal combustion engine or directly into the combustion chamber of a cylinder of the internal combustion engine. These injectors ought to have a high reliability over their lifetime and very exact injection volume.

SUMMARY

The object of the invention is to create an injector which allows for an exact dosage of the fluid volume to be injected. The given fluid is, for example, gasoline or diesel.

In some embodiments, an injector for a combustion engine comprising an injection valve housing has an injection valve cavity. The injection valve housing defines a longitudinal axis. The injector further comprises a valve needle axially movable within the injection valve cavity and with respect to the injection valve housing. The injector further comprises an electromagnetic actuator assembly. The actuator assembly may be configured to actuate the valve needle. The electromagnetic actuator assembly comprises a pole piece being fixedly coupled with respect to the injection valve housing—for example in the injection valve cavity—and an armature being axially movable within the injection valve cavity for actuating the valve needle. The armature can be mechanically fixed to the valve needle.

In some embodiments, the armature is axially displaceable with respect to the valve needle. The valve needle is only movable within certain limits with respect to the pole piece. The valve needle is operable to seal a valve of the injector in a closing position. The valve needle is axially displaceable away from the closing position for opening the valve. The armature may be operable to mechanically interact with the valve needle for displacing the valve needle away from the closing position.

The injector further comprises a damping element which is arranged and configured to mechanically interact with the valve needle and the pole piece during movement of the valve needle with respect to the pole piece. By the provision of the damping element, a very exact volume of fluid can be injected by the injector in a controllable way. Particularly catalyst heating processes during an operation of the combustion engine may require, e.g., at a cold start of the engine, an accurate injection of a low volume or mass flow of fluid, in order to comply with future requirements of injectors.

In some embodiments, the damping element is arranged inside the injection valve cavity, wherein the damping element is disposed to abut a stop face of the pole piece. This embodiment provides a stop or reference which may be required for the damping element during its mechanical interaction with the valve needle and the pole piece.

In some embodiments, the stop face is disposed at an inner surface of the pole piece. The valve needle and the damping element can be arranged or disposed near the inner side of the pole piece or inside of the pole piece.

In some embodiments, the damping element is arranged axially between the stop face of the pole piece and the valve needle. The damping element may interact with the valve needle and the pole piece during a relative axial movement of the valve needle with respect to the pole piece, for example.

For example, the pole piece has a central recess which extends axially through the pole piece. The recess comprises a step so that it has a first portion and a second portion, which first portion has a larger cross-sectional area than the second portion.

The stop face is a radially extending surface of the step which also represents a bottom surface of the first portion. The valve needle is received in the first portion so that the first portion in particular guides the valve needle in axial direction.

For example, the valve needle has an armature retainer in an axial end region of the valve needle. The armature is in particular operable to interact mechanically with the valve needle by means of the armature retainer for displacing the valve needle. The armature retainer may be partially or completely be positioned in the first portion of the central recess of the pole piece. The damping element is preferably arranged between the step of the recess and the armature retainer.

In some embodiments, the damping element is axially fixed with respect to the pole piece. The damping element may be disposed such that it only mechanically interacts with the valve needle during a final movement of the valve needle with respect to the pole piece. Said final movement relates to the opening movement of the injector or the valve needle. In other words, the damping element may be axially spaced apart from the valve needle when the valve needle is in the closing position. The damping element may be arranged in such fashion that the valve needle approaches the damping element, comes into contact with the damping element and subsequently compresses the damping element axially when the armature is operated to displace the valve needle away from the closing position.

In some embodiments, the damping element is configured to provide damping, for example mass damping, during movement of the valve needle towards the stop face of the pole piece. Mass damping shall mean that kinetic energy of the valve needle is received by the damping element during movement of the valve needle towards the stop face of the pole piece.

In these embodiments, a mechanical interaction between the valve needle and the pole piece may be rendered more controllable during an operation of the injector.

In some embodiments, the damping, in particular the mass damping, is provided for more than the final 20 μm of movement of the valve needle towards the stop face of the pole piece. The damping element may account or compensate for tolerances or inaccuracies, e.g., of the valve needle or the pole piece during a fabrication of the injector.

For example, the injector is dimensioned such that the armature is displaceable by at least 20 μm towards the pole piece while the valve needle and/or the armature retainer abuts the damping element. The armature is displaceable with respect to the valve needle and is configured to couple to the armature retainer for displacing the valve needle away from the closing position after an initial idle stroke. The idle stroke may also be called a blind lift or free lift.

Injectors having such a free lift can be operated at particularly high pressures due to the comparatively large initial impulse transfer to the needle when the accelerated armature hits the armature retainer at the end of the idle stroke. However, there is a risk that the impact of the armature on the needle leads to an unpredictable movement of the valve needle with respect to the armature immediately after the impact. When the injector is operated in a so-called ballistic mode in which the actuator assembly is de-energized before the armature comes to a rest after hitting the pole piece, said unpredictable movement of the valve needle may lead to unintended variation of the fluid quantity dispensed by the injector. In some embodiments, the dampening element dampens the movement of the valve needle in a particularly large axial range even in the ballistic operation mode. Thus, a particular precise dosing of fluid is achievable.

In some embodiments, the electromagnetic actuator assembly is configured such that an armature movement towards the pole piece within the injection valve cavity is transferred to the valve needle during an operation of the injector.

In some embodiments, the movement of the valve needle towards the stop face of the pole piece relates to an opening of the injector. According to this embodiment, sticking of the valve needle at the stop face of the pole piece, which may, e.g., be caused by hydraulic damping between the valve needle and the pole piece and effect an unintended increase of the mass flow of fluid during operation of the injector, can advantageously be prevented.

In some embodiments, the damping element comprises a viscoelastic material such as a rubber compound.

In some embodiments, the damping element is an O-ring.

In some embodiments, the armature retainer comprises a spring seat for a valve spring. The valve spring is operable to bias the valve needle towards the closing position. The valve spring may extend axially through the damping element.

In some embodiments, the damping element is mounted to the injector in a pre-compressed state. The elastic or damping properties of the damping element may be adjusted to the respective requirements of the injector.

In some embodiments, the material of the damping element is adapted for a temperature range between −40° C. and +150° C.

In some embodiments, an injector for a combustion engine comprises an injection valve housing with an injection valve cavity, a valve needle being axially movable within the injection valve cavity, an electromagnetic actuator assembly and a damping element. Each of these is in particular in accordance with one of the embodiments described above.

The electromagnetic actuator assembly comprises the pole piece being fixedly coupled with respect to the injection valve housing in the injection valve cavity and the armature being axially movable within the injection valve cavity. The pole piece has a central recess which extends axially through the pole piece and has a step so that it has a first portion and a second portion, the first portion having a larger cross-sectional area than the second portion. The pole piece has a stop surface which is a radially extending surface of the step. The valve needle has an armature retainer which is partially or completely positioned in the first portion of the central recess of the pole piece. The armature is axially displaceable with respect to the valve needle and is operable to interact mechanically with the valve needle by means of the armature retainer for actuating the valve needle. The damping element is arranged axially between the stop surface and the armature retainer to mechanically interact with the valve needle and the pole piece—in particular via the stop surface and the armature retainer—during movement of the valve needle with respect to the pole piece. In some embodiments, the damping element is in form-fit connection with the stop surface and a surface of the armature retainer facing towards the stop surface.

BRIEF DESCRIPTION OF THE DRAWINGS

Features which are described herein above and below in conjunction with different aspects or embodiments, may also apply for other aspects and embodiments. Further features and advantageous embodiments of the subject-matter of the disclosure will become apparent from the following description of the exemplary embodiment in conjunction with the figures, in which.

Figure 1:
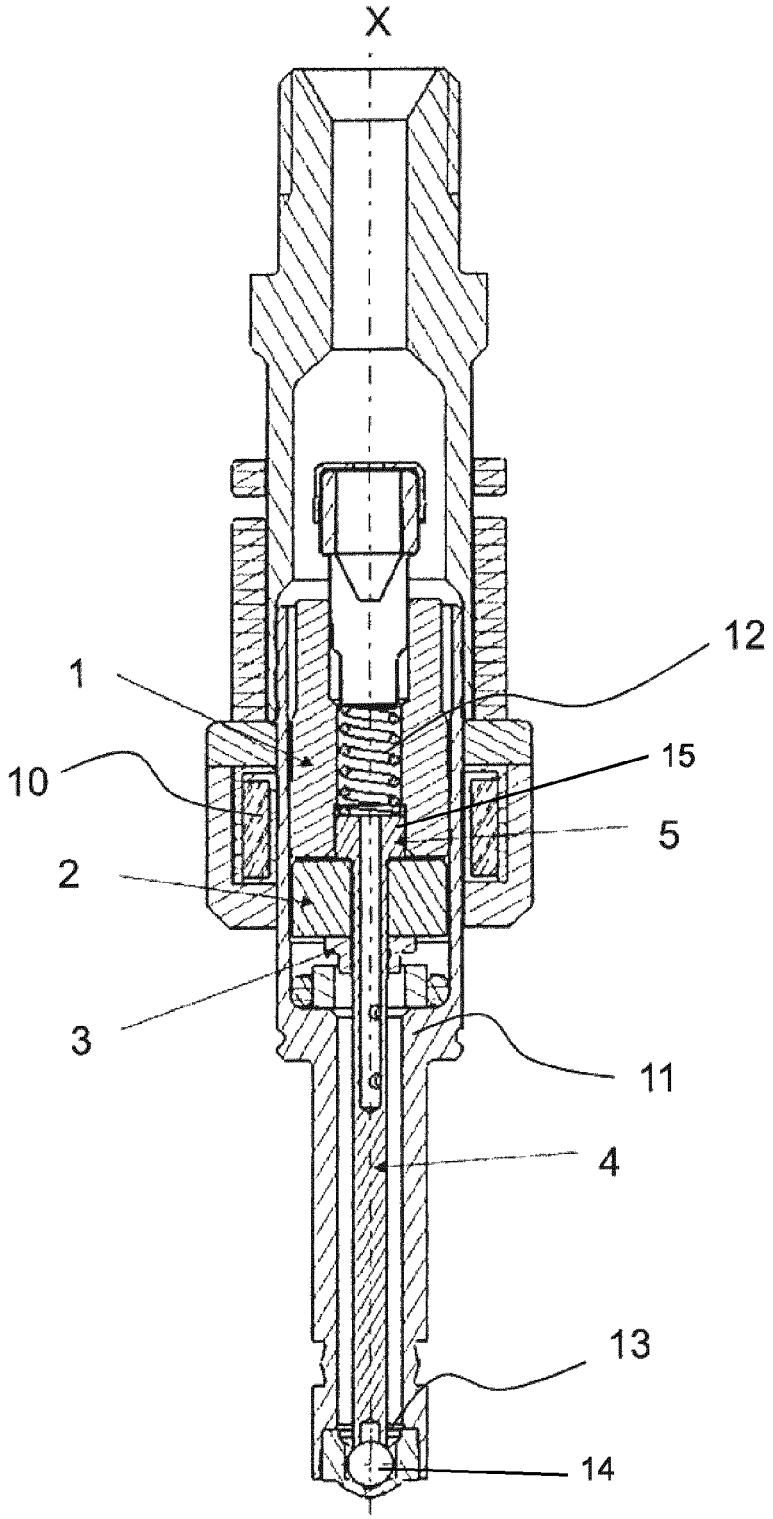
FIG. 1 shows a longitudinal section of a portion of an injector of the prior art.

Like elements, elements of the same kind and identically acting elements may be provided with the same reference numerals in the figures. Additionally, the figures may be not true to scale. Rather, certain features may be depicted in an exaggerated fashion for better illustration of important principles.

DETAILED DESCRIPTION

FIG. 1 shows a longitudinal section of an injector of the prior art, particularly, being suitable for dosing fuel to an internal combustion engine. The injector has a longitudinal axis X. The injector further comprises an injection valve housing 11 with an injection valve cavity. The injection valve cavity takes in a valve needle 5 being axially movable within the injection valve cavity relative to the injection valve housing 11. The valve needle 5 extends in axial direction X from a needle ball 14 at one axial end along a shaft 4 to an armature retainer 15 at an opposite axial end of the valve needle. In the present embodiment, the armature retainer 15 is in one piece with the shaft 4 and forms a collar at one end of the shaft. Alternatively, the armature retainer 15 can be a separate piece which is fixed to the shaft 4.

The injector further comprises a valve seat 13, on which the needle ball 14 of the valve needle 5 rests in a closed position and from which the valve needle 5 is lifted for an open position. The closed position may also be denoted as closing position.

The injector further comprises a spring element 12 being designed and arranged to exert a force on the valve needle 5 acting to urge the valve needle 5 in the closed position. The armature retainer acts as a spring seat for the spring element 12. In the closed position of the valve needle 5, the valve needle 5 sealingly rests on the valve seat 13, by this preventing fluid flow through at least one injection nozzle.

The injection nozzle may be, for example, an injector hole. However, it may also be of some other type suitable for dosing fluid.

The injector further comprises an electromagnetic actuator assembly, which is designed to actuate the valve needle 5. The electromagnetic actuator assembly, comprises a coil, in particular a solenoid 10. It further comprises a pole piece 1 which is fixedly coupled to the injection valve housing 11. The electromagnetic actuator assembly further comprises an armature 2 which is axially movable within the injection valve cavity by an activation of the electromagnetic actuator assembly.

The armature 2 is mechanically coupled or decoupled with the valve needle 5, preferably movable with respect thereto only within certain limits. In other words, the armature 2 can be positionally fixed with respect to the valve needle 5 or axially displaceable with respect to the valve needle 5, as in the present embodiment.

Axial displacement of the armature 2 with respect to the valve needle 5 in direction towards the pole piece 1 is limited by the armature retainer 15. The valve needle 5 further comprises a stop element 3 which is welded on a shaft 4 of the valve needle 5. The stop element 3 is operable to limit axial displacement of the armature 2 relative to the valve needle in direction away from the pole piece 1.

The injector applies a concept in which the armature momentum is used to generate an opening of the injector or the valve needle 5, or a movement of the valve needle 5 towards the stop face 8 of the pole piece 1 ("kick" see below). During this movement, a hydraulic load on a valve seat 13 is to be overcome.

The valve needle 5 prevents a fluid flow through a fluid outlet portion and the injection valve housing 11 in the closed position of the valve needle 5. Outside of the closed position of the valve needle 5, the valve needle 5 enables the fluid flow through the fuel outlet portion.

In case that the electromagnetic actuator assembly with the coil gets energized, the electromagnetic actuator assembly may affect an electromagnetic force on the armature 2. The armature 2 is thus displaced towards the pole piece 1. For example, it may move in a direction away from the fuel outlet portion, in particular upstream of a fluid flow, due to the electromagnetic force acting on the armature. Due to the mechanical coupling with the valve needle 5, the armature 2 may take the valve needle 5 with it, such that the valve needle 5 moves in axial direction out of the closed position. Outside of the closed position of the valve needle 5 a gap between the injection valve housing 11 and the valve needle 5 at an axial end of the valve needle 5 facing away from the electromagnetic actuator assembly forms a fluid path and fluid can pass through the injection nozzle.

In the case when the electromagnetic actuator assembly is de-energized, the spring element 12 may force the valve needle 5 to move in axial direction in its closed position. It is dependent on the force balance between the forces on the valve needle 5—including at least the force caused by the electromagnetic actuator assembly with the coil 10 and the force on the valve needle 5 caused by the spring element 12—whether the valve needle 5 is in its closed position or not.

The minimum injection of fluid, such as gasoline or diesel dispensed from the injector may relate at each injection pulse to the mass of 1.5 mg at pressures from e.g. 200 to 500 bar.

Figure 2A:
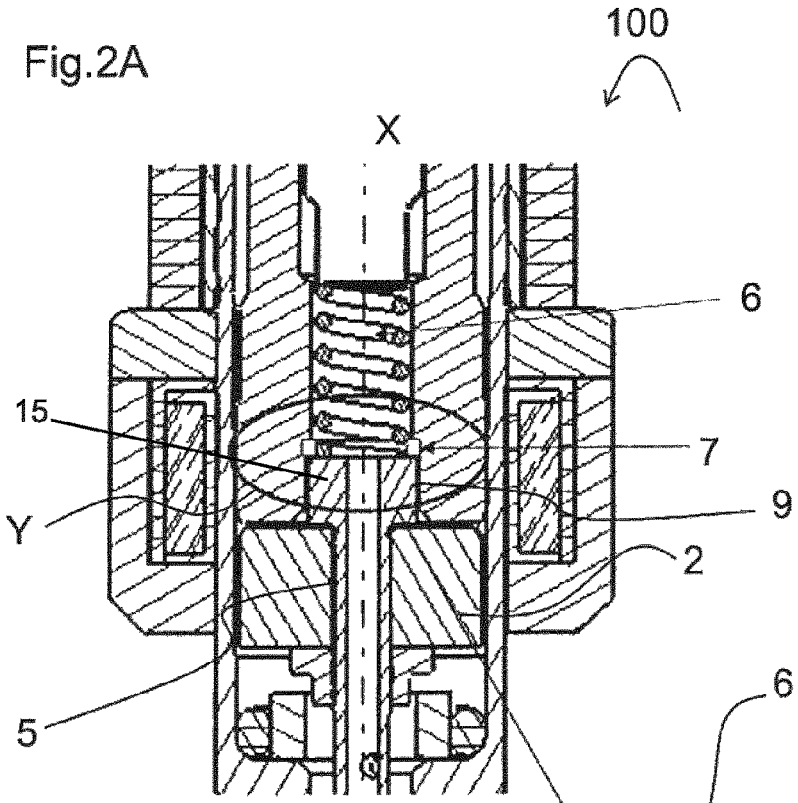
FIG. 2A shows a longitudinal section view of an injector according to teachings of the present disclosure.

FIG. 2A shows a portion of a longitudinal section of an injector 100 according to teachings of the present disclosure. In contrast to the injector shown in FIG. 1, the injector 100 of the present embodiment comprises a damping element 7 for damping of the movement of the valve needle during opening of the injector 100.

The damping element 7 is axially fixed with respect to the pole piece 1. The damping element 7 is arranged axially between the stop face 8 of the pole piece 1 and the armature retainer 15 of the valve needle 5. The damping element 7 is further disposed at an inner surface 9 of the pole piece 1.

The damping element 7 is arranged axially above, the valve needle 5, here at a position relative to the valve needle 5 facing axially away from the injector outlet or nozzle. The damping element 7 further abuts a stop face 8 of the pole piece 1 (cf. FIG. 2A).

More specifically, the pole piece 1 has a central recess 22,24 which is defined by the inner surface 9. The central recess 22,24 has a step 20 so that it is separated in a first portion 22 having a surface of the step 20 as a bottom surface and a second portion 24 upstream of the first portion 22. The bottom surface of the first portion represents the stop face 8. The second portion 24 has a smaller cross-sectional area than the first portion 22. The armature retainer 15 is arranged in the first portion 22 of the recess 22,24 of the pole piece 1 and axially guided by the first portion 22.

The spring element 12 extends from a spring seat in the second portion to the armature retainer 15 in the first portion. The armature retainer 15 acts as a further spring seat for the spring element 12.

Figure 2B:
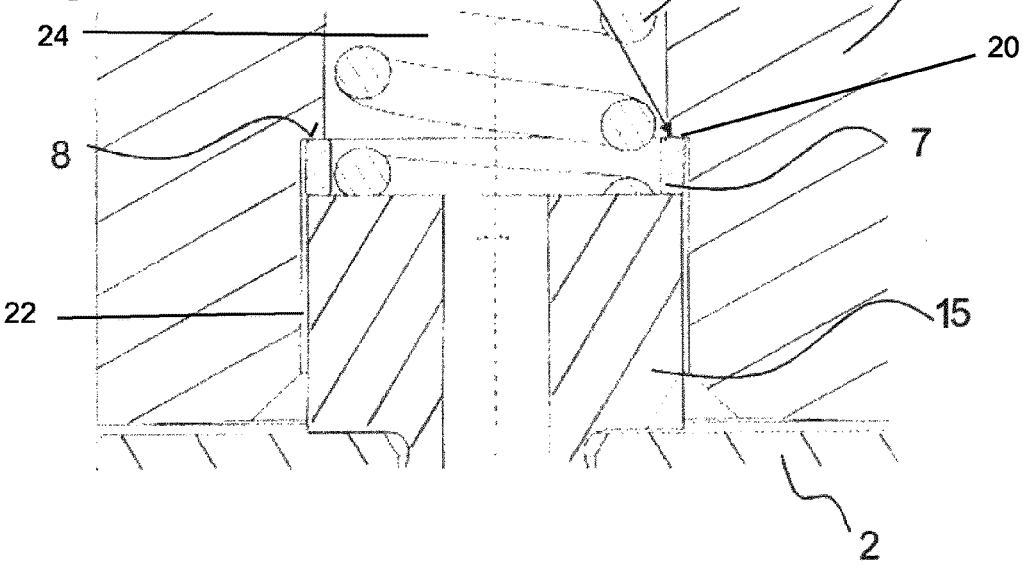
FIG. 2B shows a magnified portion of the injector shown in FIG. 2A.

FIG. 2B shows a portion Y of the injector 100 which is indicated in FIG. 2A in a magnified way. In the depicted situation the valve needle 5 actually abuts the damping element 7. This may relate to a damping operation during the opening of the injector 100. The damping element 7 may comprise a material which is adapted for a temperature range between −40 and +150° C.

The damping element 7 is preferably mounted to the injector 100 in a pre-compressed state, preferably the damping element 7 is pre-compressed by 1 to 2 N.

The damping element 7 may be an O-ring. In the present embodiment, the spring element 12 extends through the central opening of the O-ring.

Furthermore, the damping element 7 may comprise a viscoelastic material such as a rubber compound. The damping element 7 preferably, provides for a mass damping of the valve needle 5, when the valve needle 5 is moved towards the stop face 8 of the pole piece 1. Preferably, the mass damping is provided for more than the final 20 μm of movement of the valve needle 5 towards the stop face 8 of the pole piece 1.

In FIGS. 2A and 2B, opening of the injector 100 relates to a movement of the valve needle 5 upwards with respect to the pole piece 1.

The injector 100 may further comprise a further damping arrangement which provides for a hydraulic damping during movement of the valve needle away from the stop face 8 of the pole piece 1, for example during a closing of the injector. The damping arrangement may be represented mating surfaces of the armature 2 and the pole piece 1 which cooperate to provide hydraulic damping when the spring element 12 moves the valve needle towards the closed position—and, thus, the armature 2 out of contact with the pole piece 1 by means of mechanical interaction via the armature retainer 15. In addition, an additional damping arrangement may be provided for damping the movement of the armature 2 relative to the valve needle 5 when the armature 2 moves into contact with the stop element 3 of the valve needle 5.

Figure 3:
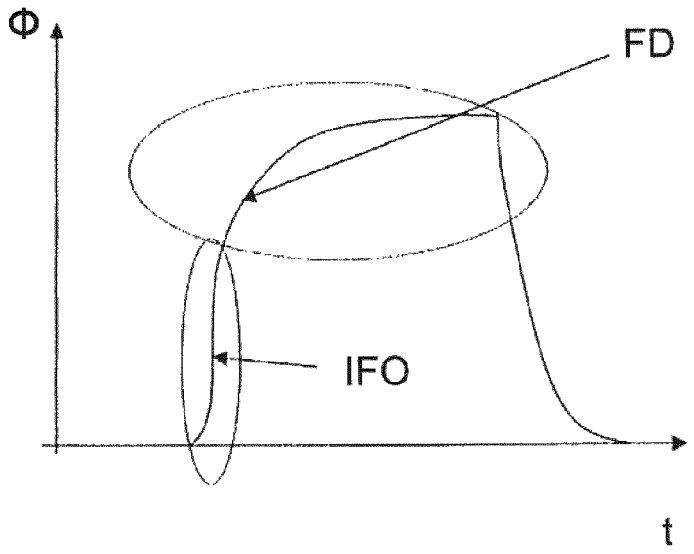
FIG. 3 shows a schematic diagram of a flow or fluid as a function of time according to teachings of the present disclosure.

FIG. 3 shows a schematic course of a fluid flow Φ actually injected as a function of time t according to teachings of the present disclosure. The section of the course indicated by IFO relates to an initial fast opening of the injector, wherein the flow Φ of fluid strongly increases over time t. The section of the cause indicated by FD relates to a final damping regime in which, due to the herein described damping mechanism of the damping element 7, the flow increase is attenuated until the flow Φ is almost constant over time.

In FIG. 3 it is shown that the initial needle opening speed is relatively high which is important to achieve a good distribution of fuel during or after the injection. Due to the fact that the electromagnetic actuator assembly is active during the opening after the movement of the armature 2, the armature 2 is further accelerated during its movement in the injector valve housing 11, when the electromagnetic actuator assembly is active. For this reason it is not easy to control the position of the valve needle 5 with good accuracy by an electronic control unit in real time. Consequently, the mass flow of fluid and the achievement of very low fuel quantities poses problems especially in the ballistic operating range. The ballistic operating range may indicate the range in which the valve needle 5 is not in contact with the valve seat 13 and/or the stop face 8 of the pole piece 1. The mentioned problems may, particularly, overcome by the teachings of the present disclosure, particularly by the provision of the mentioned damping element 7. Moreover the disclosed embodiments provide for a cost-efficient damping solution. Thereby, expensive damping solutions, such as dynamic pressure drop fixture, wherein slots or holes are provided in the armature, can be avoided.

As mentioned above, when the electromagnetic actuator assembly is activated or energized, the armature 2 is axially movable for an initial idle stroke until it contacts the armature retainer 15 of the valve needle 5 to generate the momentum and the above mentioned "kick" on the valve needle 5. Then, the armature 2 takes the valve needle 5 for about 80 to 90 μm with it on its travel towards the pole piece 1 (opening of the valve or so-called working stroke) such that the total movable distance of the armature 2 may relate to about 120 μm or 130 μm. The overall force $F_{tot}$ of the armature effected by the electromagnetic actuator assembly provides the momentum for the opening of the valve needle (cf. "kick" of the valve needle as described above). The momentum is given by the following equation:

$$\int_0^T F_{tot}(t)\mathrm{d}t = m_A * v_T,$$

wherein $m_A$ is the armature mass and $v_T$ is the speed of the valve needle 5 at the event T of the contact of the valve needle 5 and the armature 2. The damping effect generated by the damping element to reduce the speed of the valve needle and to improve the controllability of the position and consequently the minimum flow rate is described by the following damping equations:

$$F(t) = m_N\ddot{z} + D\dot{z} + \mathrm{kz},$$

$$z(t=T) \propto \int_0^T F_{tot}(t)\mathrm{d}t,$$

wherein $m_N$ is the needle mass, D is the introduced damping constant of the damping element 7 and k is the spring constant of the spring element 12.

The scope of protection is not limited to the examples given herein above. The invention is embodied in each novel characteristic and each combination of characteristics, which particularly includes every combination of any features which are stated in the claims, even if this feature or this combination of features is not explicitly stated in the claims or in the examples.

What is claimed is:

1. An injector for a combustion engine, the injector comprising:

an injection valve housing with an injection valve cavity, a valve needle axially movable within the injection valve cavity, an electromagnetic actuator assembly comprising a pole piece fixedly coupled with respect to the injection valve housing in the injection valve cavity and an armature axially movable within the injection valve cavity, and a damping element comprising a viscoelastic material, wherein the damping element is axially compressed by and seated on opposing surfaces of a stop surface of the pole piece and an armature retainer fixed to the valve needle to resist nearing movement between the valve needle and the pole piece, wherein the pole piece has a central recess extending axially through the pole piece, and the central recess includes a step defining a first portion and a second portion, the first portion having a larger cross-sectional area than the second portion, the stop surface defined by a radially extending surface of the step of the central recess, the armature retainer disposed at least partially in the first portion of the central recess of the pole piece, the armature is axially displaceable with respect to the valve needle and operable to interact mechanically with the valve needle by means of the armature retainer for actuating the valve needle.

2. The injector according to claim 1, further comprising the damping element arranged inside the injection valve cavity, and wherein the damping element is disposed to abut the stop surface of the pole piece.

3. The injector according to claim 2, further comprising the stop surface disposed at an inner surface of the pole piece.

4. The injector according to claim 1, further comprising the damping element axially fixed with respect to the pole piece.

5. The injector according to claim 1, further comprising the damping element providing mass damping during movement of the valve needle towards the stop surface of the pole piece.

6. The injector according to claim 5, wherein the mass damping is provided for more than the final 20 μm of movement of the valve needle towards the stop surface of the pole piece.

7. The injector according to claim 5, wherein the movement of the valve needle towards the stop surface of the pole piece relates to an opening of the injector.

8. The injector according to claim 1, wherein an armature movement towards the pole piece within the injection valve cavity is transferred to the valve needle during an opening of the injector.

9. The injector according to claim 1, wherein the damping element comprises an O-ring.

10. The injector according to claim 1, wherein the damping element comprises a material adapted for a temperature range between −40° C. and +150° C.

11. An internal combustion engine comprising:

a combustion chamber; and a fuel injector dosing fuel into the combustion chamber, the fuel injector comprising:

a housing with a valve cavity and a longitudinal axis;

a valve needle moving axially within the valve cavity;

a pole piece fixedly to the housing within the valve cavity;

an armature moving axially within the valve cavity;

a central recess extending axially through the pole piece, the central recess including a step defining a first portion and a second portion, the first portion having a larger cross-sectional area than the second portion;

a stop surface disposed on the pole piece defined by a radially extending surface of the step;

an armature retainer disposed on the valve needle and at least partially positioned in the first portion of the central recess; and a damping element comprising a viscoelastic material, wherein the damping element is axially compressed by and seated on opposing surfaces of the stop surface of the pole piece and the armature retainer fixed to the valve needle to resist a nearing movement between the valve needle and the pole piece;

wherein the armature moves axially with respect to the valve needle and interacts mechanically with the valve needle by means of the armature retainer for actuating the valve needle.

12. The internal combustion engine according to claim 11, further comprising the damping element arranged inside the valve cavity, and wherein the damping element is disposed to abut the stop surface of the pole piece.

13. The internal combustion engine according to claim 12, further comprising the stop surface disposed at an inner surface of the pole piece.

14. The internal combustion engine according to claim 11, further comprising the damping element axially fixed with respect to the pole piece.

15. The internal combustion engine according to claim 11, further comprising the damping element providing mass damping during movement of the valve needle towards the stop surface of the pole piece.

16. The internal combustion engine according to claim 15, wherein the mass damping is provided for more than the final 20 μm of movement of the valve needle towards the stop surface of the pole piece.

17. The internal combustion engine according to claim 11, the damping element comprises a material adapted for a temperature range between −40° C. and +150° C.

* * * * *